US009482064B2

(12) United States Patent
Aarsland et al.

(10) Patent No.: US 9,482,064 B2
(45) Date of Patent: Nov. 1, 2016

(54) DRUM UNIT WITH AN ARCH COMPENSATOR FOR A WELL INTERVENTION STRING

(71) Applicants: C6 Technologies AS, Stavanger (NO); Stimline AS, Kristiansand S (NO)

(72) Inventors: Tore Aarsland, Nærbø (NO); Mads Bjørnenak, Kristiansand S (NO); Kenny Armstrong, Stavanger (NO); Erik Zachariassen, Kristiansand S (NO)

(73) Assignees: C6 TECHNOLOGIES AS, Stavanger (NO); STIMLINE AS, Kristiansand S (NO)

( * ) Notice: Subject to any disclaimer, the term of this patent is extended or adjusted under 35 U.S.C. 154(b) by 815 days.

(21) Appl. No.: 13/906,045

(22) Filed: May 30, 2013

(65) Prior Publication Data

US 2014/0014317 A1 Jan. 16, 2014

Related U.S. Application Data

(60) Provisional application No. 61/653,239, filed on May 30, 2012.

(51) Int. Cl.
*E21B 19/22* (2006.01)
*B66D 1/39* (2006.01)

(52) U.S. Cl.
CPC ..... *E21B 19/22* (2013.01); *B66D 1/39* (2013.01)

(58) Field of Classification Search
CPC .... E21B 17/20; E21B 19/008; E21B 19/086; E21B 19/22; B65H 54/2803; B66D 1/39; B66D 3/20; B66D 1/20
USPC ..... 242/557, 566, 615.2, 615.3
See application file for complete search history.

(56) References Cited

U.S. PATENT DOCUMENTS

| | | | | |
|---|---|---|---|---|
| 689,492 | A | 12/1901 | Hughes | |
| 2,810,439 | A | 10/1957 | McCullough et al. | |
| 3,524,606 | A | 8/1970 | Coski | |
| 3,690,409 | A | 9/1972 | Brauss | |
| 4,492,363 | A | 1/1985 | Niskin | |
| 4,743,175 | A * | 5/1988 | Gilmore | B65H 51/14 166/77.2 |

(Continued)

FOREIGN PATENT DOCUMENTS

| | | |
|---|---|---|
| DE | 1170126 B | 5/1964 |
| DE | 199 42 608 A1 | 4/2001 |

(Continued)

*Primary Examiner* — Nicole Coy
*Assistant Examiner* — Kristyn Hall
(74) *Attorney, Agent, or Firm* — Birch, Stewart, Kolasch & Birch, LLP

(57) ABSTRACT

A drum unit for an intervention string for a well includes a drum with a drum axis and with a radius, arranged in a structural frame and rotatable by a motor and a tension compensator. The tension compensator includes a guide arch displaceable in a direction generally along the intervention string, orthogonal to the drum axis, using a first force device connected to the structural frame for keeping the intervention string in tension. At least a first end of the guide arch is laterally displaceable in a direction generally orthogonal to the intervention string, parallel with the drum axis. The intervention string runs between the guide arch to or from the first end to the drum. The intervention string runs via a second, opposite end of the guide arch via a second, fixed guide at the structural frame, directly or indirectly to or from the well.

28 Claims, 7 Drawing Sheets

(56) References Cited

U.S. PATENT DOCUMENTS

| | | | | |
|---|---|---|---|---|
| 5,291,956 | A * | 3/1994 | Mueller | E21B 7/18 175/424 |
| 6,006,839 | A | 12/1999 | Dearing et al. | |
| 7,753,344 | B1 | 7/2010 | Moretz et al. | |
| 2002/0195255 | A1* | 12/2002 | Reilly | E21B 19/24 166/384 |
| 2003/0010505 | A1 | 1/2003 | Gipson | |
| 2004/0118556 | A1 | 6/2004 | Widney | |
| 2004/0182574 | A1* | 9/2004 | Adnan | G05B 15/02 166/250.01 |
| 2004/0188101 | A1 | 9/2004 | Moretz | |
| 2008/0265226 | A1* | 10/2008 | Richards | B66D 1/38 254/267 |

FOREIGN PATENT DOCUMENTS

| | | | |
|---|---|---|---|
| EP | 0 571 207 | A1 | 11/1993 |
| FR | 2044130 | A5 | 2/1971 |
| FR | 2843954 | A1 | 3/2004 |
| FR | 2868408 | A1 | 10/2005 |
| GB | 1401422 | A | 7/1975 |
| GB | 2 296 001 | A | 6/1996 |
| GB | 2457585 | A | 8/2009 |
| JP | 57141989 | U | 9/1982 |
| JP | 61-277561 | A | 12/1986 |
| RU | 2 151 264 | C1 | 6/2000 |
| WO | WO 2006/027553 | A1 | 3/2006 |
| WO | WO 2010/117162 | A2 | 10/2010 |

* cited by examiner

Fleet angle forward position of tensioner

DRUM UNIT WITH AN ARCH COMPENSATOR FOR A WELL INTERVENTION STRING

INTRODUCTION

The present invention relates to a cable drum with an arch compensator for an intervention string. More specifically the invention comprises a device for relative motion between a cable and a cable drum within a frame in order to keep a constant or very low fleet angle for the winding or unwinding string. In one embodiment the drum is arranged to move axially within the frame. In another embodiment the cable is moved laterally relative to the drum.

BACKGROUND ART AND PROBLEMS RELATED THERETO

In well intervention operations using a string spooled externally onto drum while using an intervention string laying guide imposing a fleet angle is used. The laying guide shifts the intervention string laterally and imposes a fleet angle on the string. A fleet angle variation with otherwise constant drum rotation speed and string speed usually incurs a tension variation which is undesired. Several of the published patents comprise a drum with a pivotable rotational the drum.

U.S. Pat. No. 3,524,606 Cable reel mounting, describes a drum for lowering and hauling a cable through a set of horizontal guide rollers on top of a vertical pipe. The drum axis is arranged pivotable so as for allowing the cable to run tangentially between the drum and the rollers for all lateral positions of the cable on the drum, so as for reducing fleet angle variation of the cable relative to the drum.

U.S. Pat. No. 3,690,409 describes another pivotable drum arranged for keeping the fleet angle close to the perpendicular line of the drum by shifting the ends of the drum axially while the cable is wound or unwound. An advantage of U.S. Pat. No. 3,690,409 is an increased allowable axial length of the drum and thus an increased cable length capacity.

GB2296001 describes a winch apparatus for deploying or taking in line over a pulley arranged at a distance from the drum. The drum axis is pivotable so as for maintaining the fleet angle of the line near the perpendicular.

WO2006/027553 Richards describes a drum wherein the incoming line runs via a diamond screw controlled line guide which lays the cable with a fleet angle nearly perpendicularly on the drum. The diamond screw controlled line guide allows for the line to be directed parallel with the drum axis.

DE19942608 Becker describes a winch with an axially translating wire drum with a single ply. The axial translation for the wire drum is for guiding the wire in through a fixed entry position of the winch, while the drum is alternating along its axis.

WO2010/117162 also describes such an axially translating drum in a frame with a fixed entry point.

U.S. Pat. No. 7,753,344 to Moretz also describes an axially translating drum in a winch housing with a centrally arranged fixed entry position on the housing.

U.S. Pat. No. 2,810,439 McCullough describes a wellhead winch with an axially translating drum in a winch housing, wherein the winch housing is arranged for being connected under pressure to the wellhead.

EP0571207 describes a winch assembly with a translating drum and a fairlead for guiding the wire onto the drum under a desired fleet angle.

Another problem in the prior art is related to relative speed variations between the drum and the injector head. If we try and stop an intervention string during a hauling operation running the string out of the well, we run the risk of damaging the cable or the injector head very quickly. This is due to the inertia of the different components involved, because the injector head motors move less mass and are much faster to respond than the spooling unit motor which rotates a drum of considerable rotational inertia. Conversely, while feeding the intervention string into the well and suddenly stop it, the rotational inertia of the large drum with its coiled-up string means that it will continue to try and give out cable despite the injector head has already stopped the cable. The usual way of compensating for such speed differences often used in coiled tubing rig ups is to let the coiled tubing travelling through the air, so when it is stopped or started quickly the length of the free air arch changes to compensate. However a free travel of the intervention string hanging in an arch between the injector head's gooseneck and the spooling unit may not be desirable both from safety considerations both to operators or mechanical damage, particularly when the distance is large and swinging movements of the string may be considerable.

If an internal laying drum is used, and the injection head is running the cable into the well and suddenly stops, the inertia of the large drum means that it will continue to try and give out the rigid cable even though the injector head has already stopped. This may damage the cable through longitudinal compression with subsequent buckling or dislocation.

BRIEF SUMMARY OF THE INVENTION

The above problems may be remedied through use of the present invention. The invention is a drum unit (T) for an intervention string (0) for a well, comprising:

- a drum (1) for said intervention string (0) with a drum axis (10) and with a radius (R), arranged in a structural frame (2) and rotatable by a motor (22);
- a tension compensator (3) for said intervention string (0), wherein said tension compensator (3) comprises a guide arch (31) displaceable in a direction generally along the intervention string (0), orthogonal to said drum axis (10), using a first force device (6, 6B, 62B) connected to said structural frame (2) for keeping said intervention string (0) in tension;
- wherein at least a first end (31A) of said guide arch (31) is laterally displaceable in a direction generally orthogonal to said intervention string, parallel with said drum axis (10),
- wherein said intervention string (0) runs between said guide arch (31) to or from said first end (31A) to said drum (1);
- wherein said intervention string (0) runs via a second, opposite end (31B) of said guide arch (31) via a second, fixed guide (5) at said structural frame (1), directly or indirectly to or from said well.

Further features of the invention are given in the dependent claims attached.

BRIEF DESCRIPTION OF THE DRAWINGS

The invention is illustrated in the attached drawings, wherein.

EMBODIMENTS OF THE INVENTION

Figure 1A:
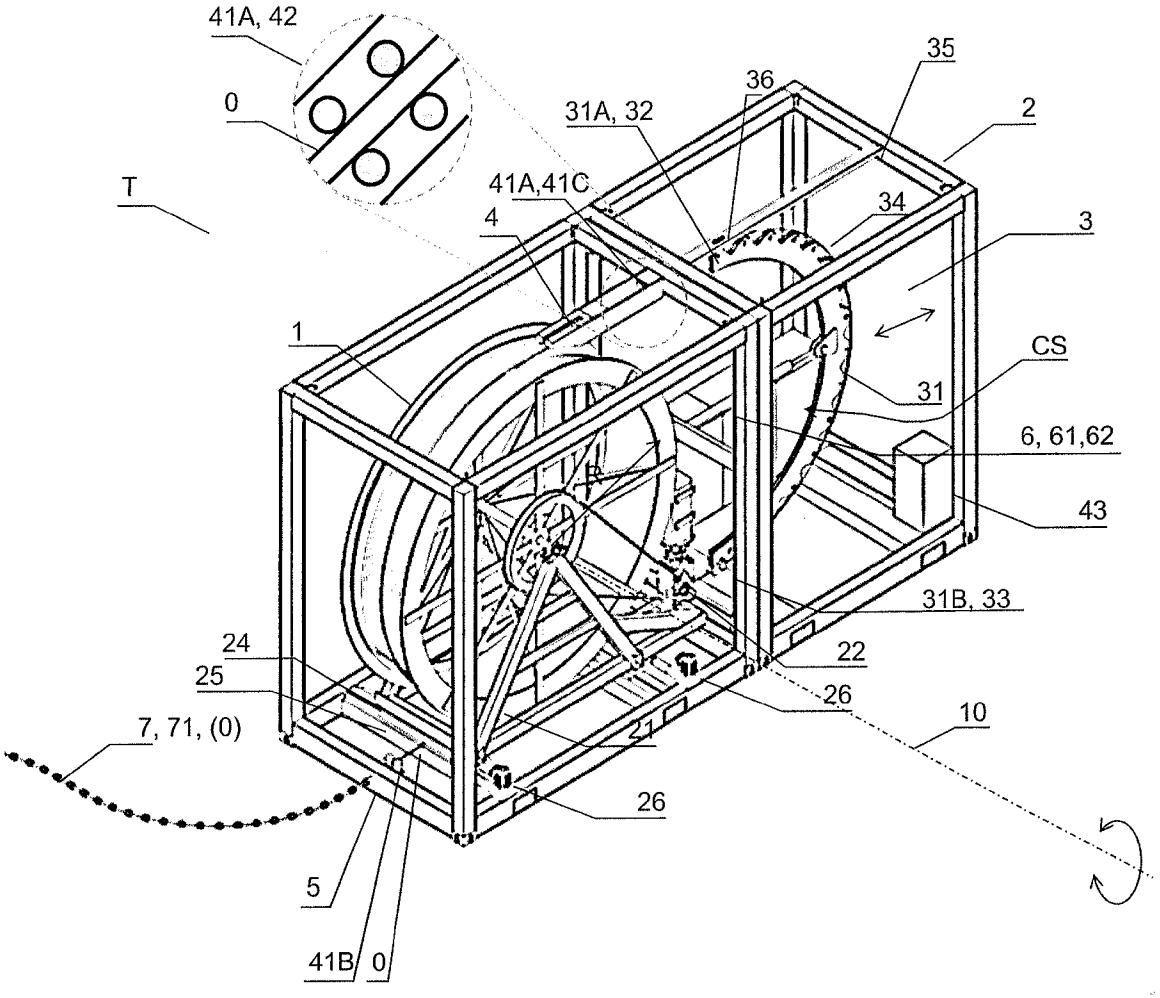
FIG. 1A is an isometric view of a drum unit (T) according to the invention, with an intervention string partly wound up onto the drum. The intervention string is for a well. The drum is driven by a motor. The drum unit is provided with a compensator for keeping a desired tension level in the intervention string (3) during the running of the drum. Further, the compensator arm is arranged laterally displaceable driven by an actuator, in a direction perpendicularly to the string for laying the string in a controlled way onto the drum. The entire drum apparatus is arranged in a steel frame. The intervention string may be a carbon fibre reinforced relatively stiff cable, or an ordinary intervention string or coiled tubing, is shown running out (or in) to the drum unit.
Figure 1B:
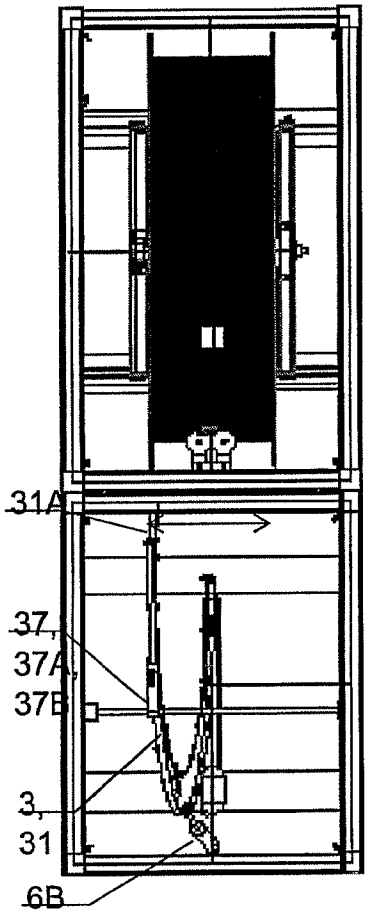
FIG. 1B is a top view of the same embodiment of the invention shown in FIG. 1B.
Figure 2:
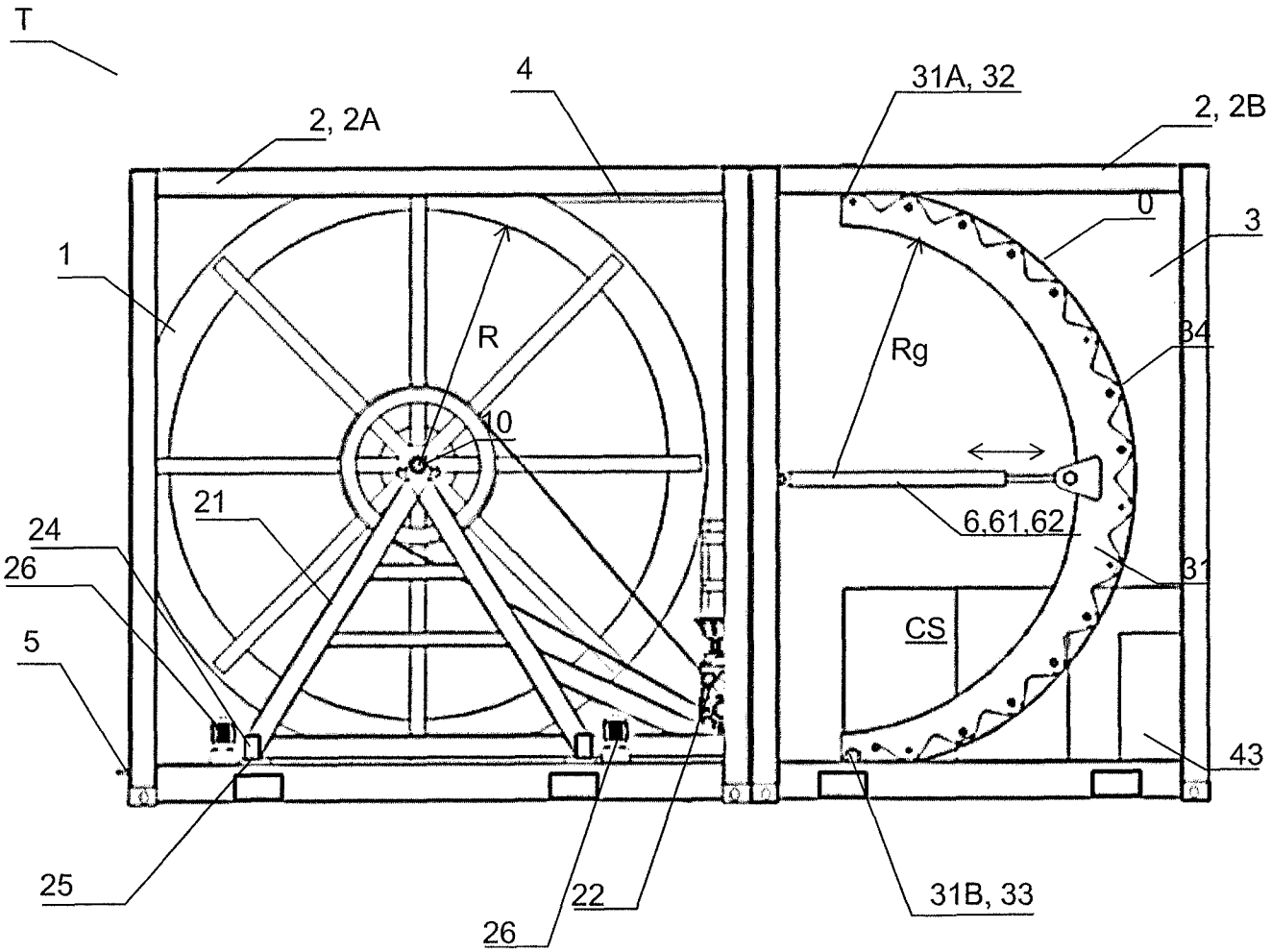
FIG. 2 is a side elevation view of a similar embodiment of the drum unit of the invention, with the frame (2) with the drum in the left frame part 2A, and the compensator shown in the right frame portion 2B. The two frame portions may in an embodiment be split for being transported separately. A difference between this embodiment and the embodiment of FIG. 1 is the position of attachment of the compensator tension mechanism (6).

The invention is illustrated in FIG. 1 and FIG. 2, a drum unit (T) for an intervention string for a well, in particular a petroleum well. The drum unit comprises the following main features:

A drum (1) with a radius (R) for the intervention string (0), the drum (1) arranged in a structural frame (2) and rotatable by a motor (22). The drum (1) has a radius (R) equal to or larger than a smallest allowable bending radius (R0) for the intervention string. For carbon fibre reinforced intervention rods of radii Ø8 mm to Ø15 mm used by the applicant, the smallest allowable bending radius (R0) may be between 0.5 m and 2 m. The diameter of the drum should thus be >=2R0, between 1 m and 4 m. The drum (1) should be accommodated to the largest of these and have a diameter of 4.0 m so the typical height of the frame would be larger than the drum, e.g. 4.2 m. Such a drum may accommodate a cable length of 10 kilometers for a 010 mm cable. Cables such as composite fibre reinforced cables or other wireline cables intended for use on the drum may have diameters varying from 8 mm to 15 mm. A long synthetic fibre cable may thus be injected by means of a drum unit and a wellhead injector into a wellhead and extended to near the end of a laterally deviated well. The drum unit is provided with a tension compensator arch of which a first end is laterally displaceable in the direction of the drum. Thus we achieve controlled winding relative of the intervention string (0) in that the intervention string may run in a controlled line relative to the drum (1) in the structural frame (2) during the laying of the intervention string (0) onto the drum (1). The intervention string is thus shifted laterally to the left and right onto the drum during receiving or feeding out the intervention string. A lateral angle on the intervention string, which is almost generally avoided with the present invention, is called a fleet angle. A fleet angle variation with otherwise constant drum rotation speed and string speed usually incurs a tension variation, and the absence of a fleet angle away from the perpendicular line, and its cable tension variation is taken up by the compensator arch moving a small length in and out with the varying entry point onto the drum. Such tension variations would otherwise have required that the intervention string had to be operated at a lower maximal tension onto the drum than by the present invention. The alternative of running the drum at a speed varying with the fleet angle is prohibitive if the drum is large.

FIG. 5 illustrates the compensator arch in a retracted position closest to the drum, and with the compensator arch displaced to one side of the drum. The fleet angles between the string and the compensator arm is below 1.6 degrees and the arm is laid over 8 degrees or less laterally.

FIG. 6 shows the same as FIG. 5 except for the compensator arch being retracted to an extended position relative to the drum. The fleet angle out of the compensator arch's top is 1.5 degrees or less, and the compensator arch is 8 degrees or less inclined laterally.

The width (aial length) of the drum (1) should be less than or equal to 1/1 of the internal width of the frame. In the present invention an embodiment has a drum width of about 1/3 as illustrated, i.e. 0.84 m. The maximal width of the drum is the entire width of the frame; e.g. about 2.5 m. Such a widening of the drum would incur significantly larger maximal lateral deviation angles for the compensator arch, and somewhat increased fleet angles out of the compensator arch for the increased lateral extension, particularly in the retracted position.

The tension compensator (3) is for keeping a desired tension in the intervention string (0) during the running of the intervention string onto and out of the drum (1). The compensator tightens the intervention string or yields when speed variations between the injector head's feeding speed and the speed of the drum occur. The tension compensator (3) also yields when it moves away from the central plane of the drum in order to compensate for tension variations which could be compared to an otherwise varying fleet angle.

The drum shall operate as a slave subordinate to the injector head.

The tension compensator (3) comprises a guide arch (31) for guiding the intervention string (0). The radius (Rg) for the intervention string (0)'s path along the guide arch (31) is larger or equal to the least allowable bending radius (R0) for the intervention string (0). In an embodiment the radius may be the same for the guide arch and for the drum. The guide arch (31) is displaceable to and from the drum, i.e. in a direction orthogonal to said drum axis (10), by means of a "force device" (6) attached to the structural frame (2), i.e. a spring or an actuator or a combination of the two. Other varieties of a force device may be used. In an embodiment of the invention the neutral plane of the guide arch (31) is a central vertical plane through the frame (2) and the drum as seen in FIG. 1B, wherein the guide arch (31) is deviated to one side of the drum.

The intervention string (0) runs between a first end (31A) of the guide arch (31) and a tangential point on the drum (1), please see the upper part of the guide arch in FIG. 1 or 2. The tension compensator (3) comprises a guide arch (31) displaceable in a direction generally along the intervention string (0), orthogonal to said drum axis (10), using a first force device (6, 6B, 62B) connected to said structural frame (2) for keeping said intervention string (0) in tension. A first guide (4) may be arranged moving in synchrone with the lateral movement of the guide arch. The first guide (4) may be arranged on said first end (31A) of the guide arch (31) or actuator-driven laterally on the frame.

The intervention string (0) runs via a second, opposite end (31B) of the guide arch (31) via a second, fixed guide (5) at the structural frame (1), please see the lower left part of the frame in FIG. 1, indirectly to the well.

In an embodiment of the invention the drum unit according to the invention, the guide arch is provided with a second force device (37), please see FIG. 1, FIG. 5 and FIG. 6, for moving said first end (31A) laterally so as for steering said intervention string onto said drum (1).

Figure 4:
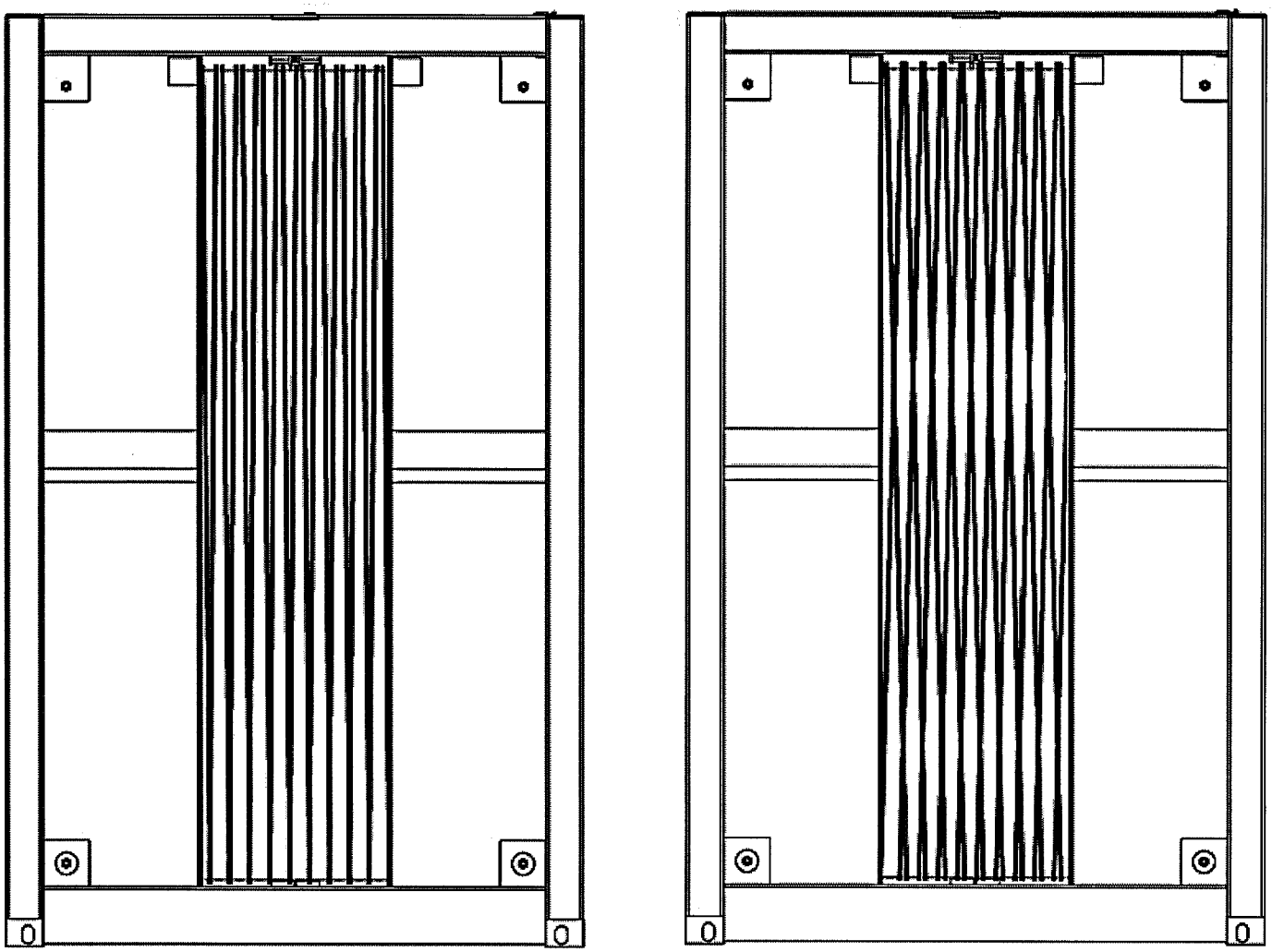
FIG. 4 shows end views with two different layup patterns on a drum according to the invention.
Figure 5B:
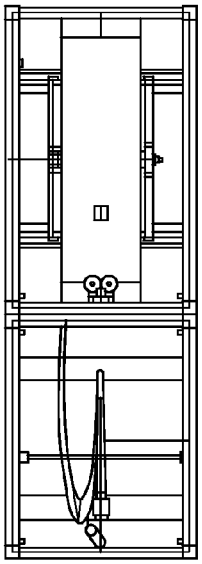
FIGS. 5A, 5B, 5C, and 5D show a top view of a drum unit according to the invention, and a perspective view, an end view as seen from the compensator arch's end, and a side view, all with the compensator arch in a 15 retracted position closest to the drum, and with the compensator arch displaced to one side of the drum.
Figure 5A:
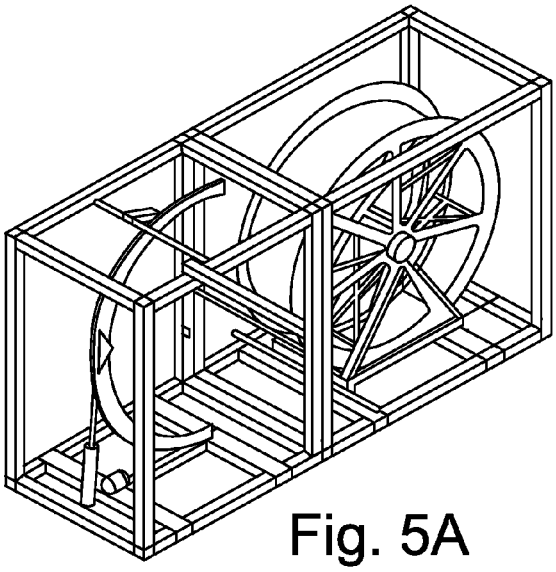
Figure 5D:
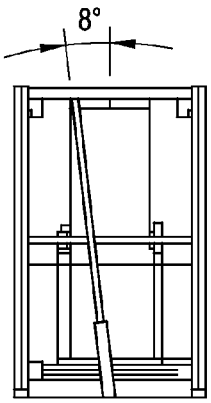
Figure 5C:
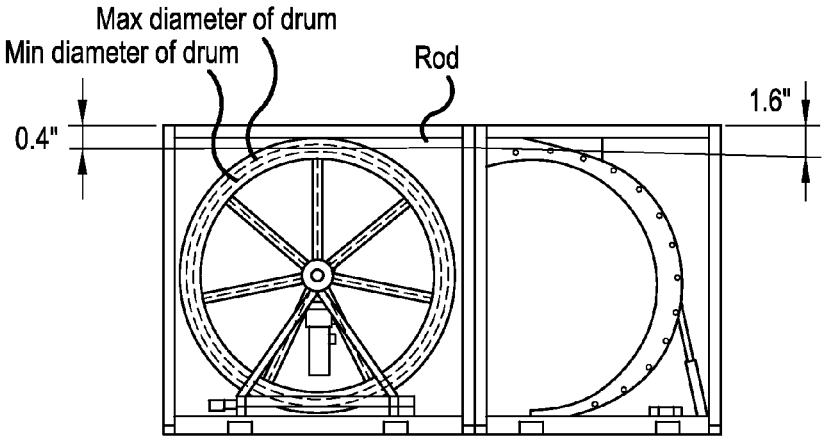
Figure 6B:
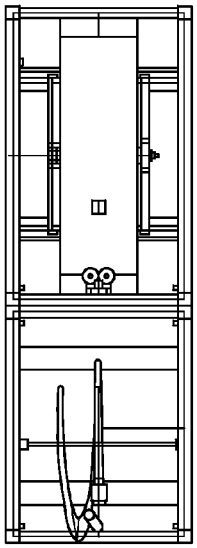
FIGS. 6A, 6B, 6C, and 6D show the same as FIGS. 5A, 5B, 5C, and 5D except for the compensator arch being retracted to an extended position relative to the drum.
Figure 6A:
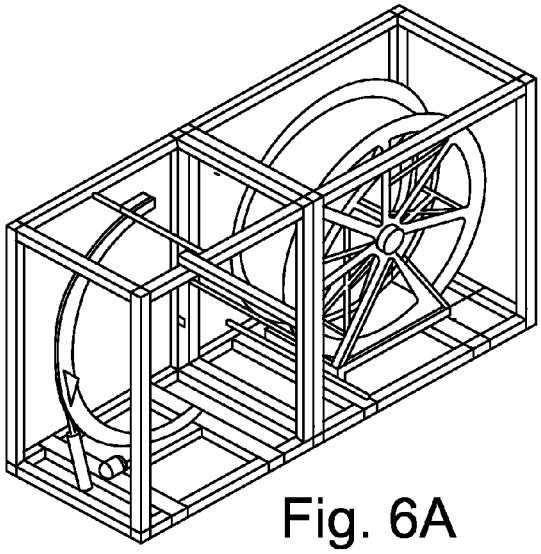
Figure 6D:
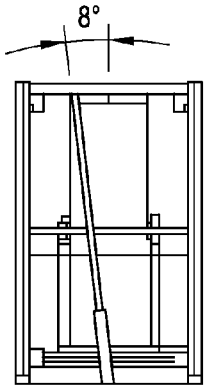
Figure 6C:
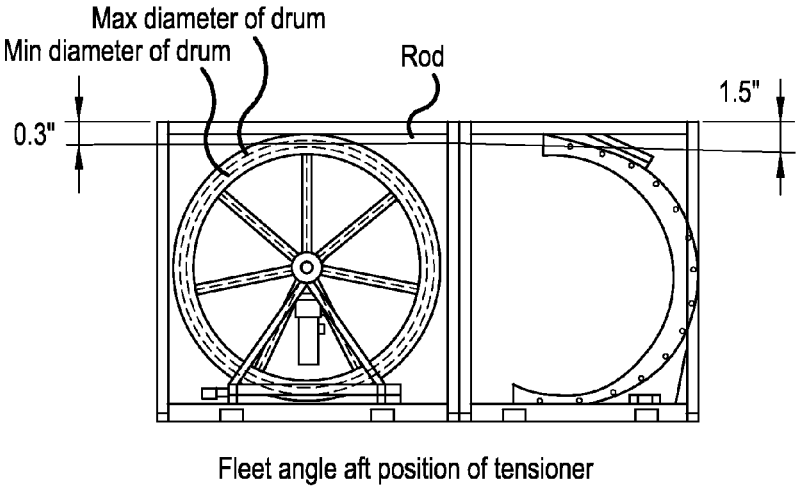

In an embodiment of the invention, the drum unit according to the invention, the base of said drum (1) is provided with a groove (11) so as for guiding the base layer of the intervention string into a desired pattern on the drum. The inventors have during prototype experiments discovered that with such a groove (11) in the base of the drum, this feature may make the second force device redundant, as the incoming intervention string is steered onto the drum by the groove when winding up the base layer onto the drum, and then steers itself laterally for the subsequent string layers onto the drum, and all the time moves the guide arch's first end (31A) along with it with a very small fleet angle. The drum may in this embodiment be provided with a Lebus helical groove along the base so as for steering the first layer of the cable into an even pattern. The next layer on the drum will lay itself neatly onto the base layer, and so on. In this embodiment the inventors have discovered that the compensator arm does not have to be provided with the lateral displacement actuator (37), but winds up nicely with the intervention string turns wound side by side. However, this embodiment may readily be combined with the embodiment above for assuring that the intervention string will go into a desired laying pattern, such as a dense laying pattern with the string always laid side-by-side for the densest layering, or in other desired patterns such as shown in FIG. 4.

In an embodiment of the invention the curve radius of said guide arch (31) is smaller near its lower second end (31B) and increases towards it upper, first end (31A). This has been tried on the prototype and reduces the string tension slightly when hauling in on the drum, which is advantageous for reducing the laying tension.

ADVANTAGES

The fleet angle onto the drum will be negligible when the first, top end (31A) of the guide arch (31) guides the laying onto the drum (1) the intervention string (0). The guide arch will, given the dimensions of the drum, arch and frame shown in FIG. 5A be pivoted laterally up to 8 degrees left or right for the laying to reach the flanges of the drum. This will slightly twist the intervention string (0), minimally, and the twist may easily be taken up anywhere between the lower end (31B) of the guide arch (31) and the second, fixed guide (5) which is the entry point for the intervention string (0) on the fixed frame (2). Additionally, a wider drum may be used than the 1/3 or 1/2 width drum illustrated: A full width drum may be used.

Bending of the cable is very small, and more importantly one avoids the variations in tension with varying fleet angle because the "curved fleet angle" provided with the laterally moving compensator arm is, as its name indicates, compensated by in-line variation of the position of the compensator arm. The lateral force required to steer the cable into its desired position of the drum is negligible and facilitates the laying of the cable to an appropriate position to facilitate the correct desired spooling pattern of the string member.

In a preferred embodiment of the invention the drum is an external laying drum, as shown in the drawings. The laying pattern may be plain, side by side without any crossings as illustrated in FIG. 1 for fully utilizing the capacity of the drum, or laid in a braided pattern with one or more crossings per revolution if another pattern is desired, as illustrated by two examples in FIG. 4.

In an embodiment of the invention the guide arch (31) is arranged linearly displaceable, i.e. it translates to and from the drum. In another embodiment it is displaceable by being pivoted about a first, upper, or second, lower axis (32, 33) arranged in the frame (1).

In an embodiment of the invention guide arch (32) may be constituted by a rotating sheave wheel that can translate back and forth, and be pivotable about the axis of the incoming cable. However, a significant advantage of using an approximately 180 degrees arch (32) as shown in FIG. 1 and FIG. 2 is the considerably reduced space requirement compared to a full sheave.

The force device (6) may in an embodiment of the invention comprise a spring mechanism (61). The force device (6) may alternatively or in addition to a spring mechanism comprise a pneumatic, hydraulic or electrical actuator (62). In FIG. 1 and FIG. 2 a hydraulic piston embodiment is shown.

The drum (1) is according to an embodiment arranged in bearings on an auxiliary frame (21). The auxiliary frame may, if it is narrower than the frame, be mounted on transverse rails (25) arranged in the lower structure of the structural frame (1).

The drum unit according to the invention is in an embodiment provided with one or more string tension feeder units (41, 41A, 41B) arranged either on the compensator arm or on the structural frame (2). The string tension feeder units exert at least a minimally required tension on the intervention string (0) outwardly directed from said drum (1) and are arranged for feeding the intervention string (0) in a desired direction outwardly from or inwardly to said drum (1). The tension feeder unit (41) shall preferably be employed during rigging and connection to the injector head (8). When the injector head on the well has received the intervention string (0) the tension feeder units may be set in freewheel mode or disconnected. However, the tension feeder units may be operated during feeding out the rather stiff intervention string from the drum in order to prevent the string from raising off the drum. Speed differences between the drum and the string would be taken up by the compensator guide arch of the invention anyway.

In an embodiment of the invention, the drum unit (T) is provided with a tension feeder unit (41A) arranged at a first guide (4) for said string, said tension feeder unit (41A) arranged laterally moving with said first end (31A) of said guide arch (31).

In an embodiment of the invention said tension feeder unit (41A) is arranged at said first guide (4) arranged on said first end (31A) of said tension compensator (3).

In an embodiment, the tension feeder unit (41A) at said first guide (4) is arranged laterally displaceable on said structural frame (2), said tension feeder unit (41A) arranged laterally moving in lateral synchronous operation with said first end (31A) of said guide arch (31). In an embodiment the syncrhonous operation may be governed by means of an actuator (41C).

Said tension feeder unit (41A, 41B) may comprise two or more motorised rollers or belts (42) oppositely arranged on either sides of said intervention string's (0) path and arranged for gripping and exerting a longitudinally directed force on said intervention string (0).

According to an embodiment of the invention a tension feeder unit (41B) is arranged by the second, fixed guide (5), please see FIG. 1. This will allow the end of the intervention string, or a whip attached to the end of the string, to be held at this point of the frame structure when the intervention string is hauled in all the way to the frame (2). This tension feeder unit (41B) may operate alone and may hold an outer end or "whip" of the intervention string (0) by said frame (2) when the intervention string (0) is entirely coiled in onto the drum. Then, however, with the string laid over the compensator arch, the structural frame (2) may not be split into two parts, a drum frame (2A) and a compensator frame (2B) because the whip or outer end of the intervention string (0) still is laid around the guide arch (31) and locks it in place.

Figure 7:
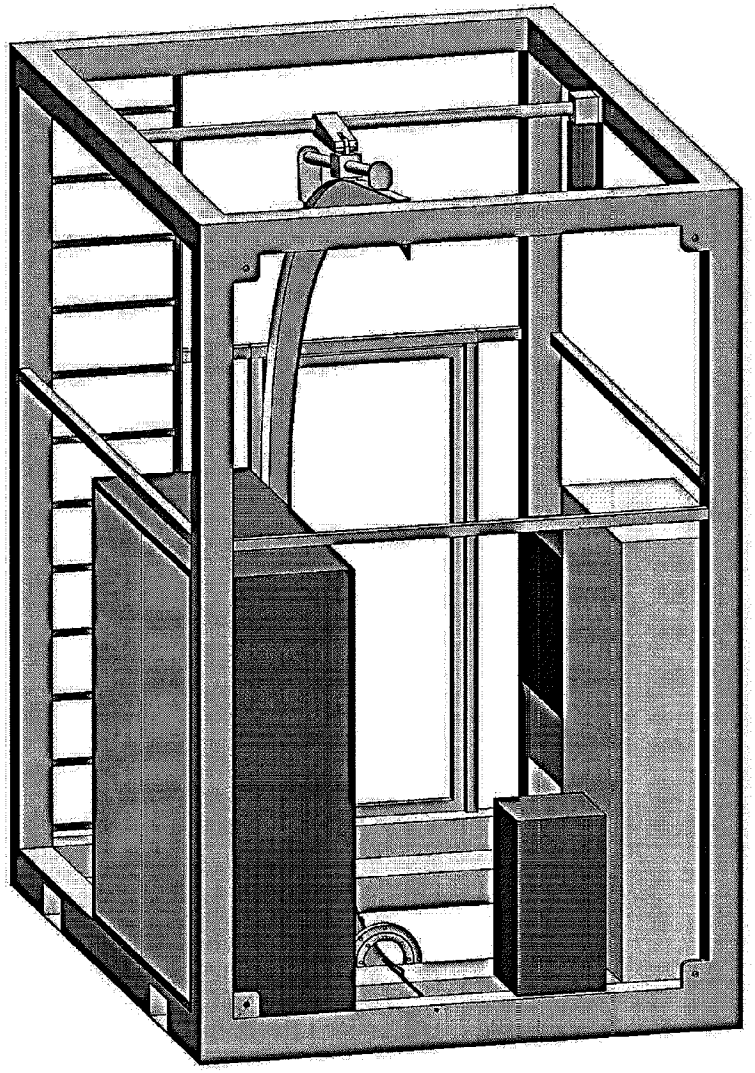
FIG. 7 shows a separate frame section (2B) with the compensator arch, as seen from the main drum frame section (2A) position.

FIG. 7 shows a separate frame section (2B) with the compensator arch, as seen from the main drum frame section (2A) position. The cabinets shown in the right and left lower portions may provide space for control units, hydraulic brake or motor units, and hydraulic units for the compensator arm. The placement near the lower fixed point of the arm gives ample space for the lateral movement of the compensator arch.

However, if the whip or outer end of the intervention string is allowed to be pulled further in onto the drum and locked in a first tension feeder unit (41A), and this is arranged at the drum frame (2A), further in relative to the guide arch (31), the guide arch (31) and the compensator frame (2B) are free may and may be disconnected, please see below. Then the structural frame (2) may be disassembled into a drum frame (2A) and a compensator frame (2B) and allow them to be transported as two separate parts.

In an embodiment of the invention the first tension feeder unit (41A) is arranged at said first guide (4).

The tension feeder unit (41A, 41B) may in an embodiment comprise two motorised rollers or belts (42) oppositely arranged on either sides of said intervention string's (0) path and arranged for gripping and exerting a longitudinally directed force on said intervention string, please see the insert detail in the upper left portion of FIG. 1.

Braking using the motorised rollers or belts will generate heat irrespective of the motorised rollers use hydraulic or electric energy. As the brakes are small and there is a risk that they must brake for extensive lengths, large amounts of heat may be generated. The heat generated by the braking may be taken out in a hydraulic brake resistor (43) which may dissipate the heat away from the brake itself.

Figure 3:
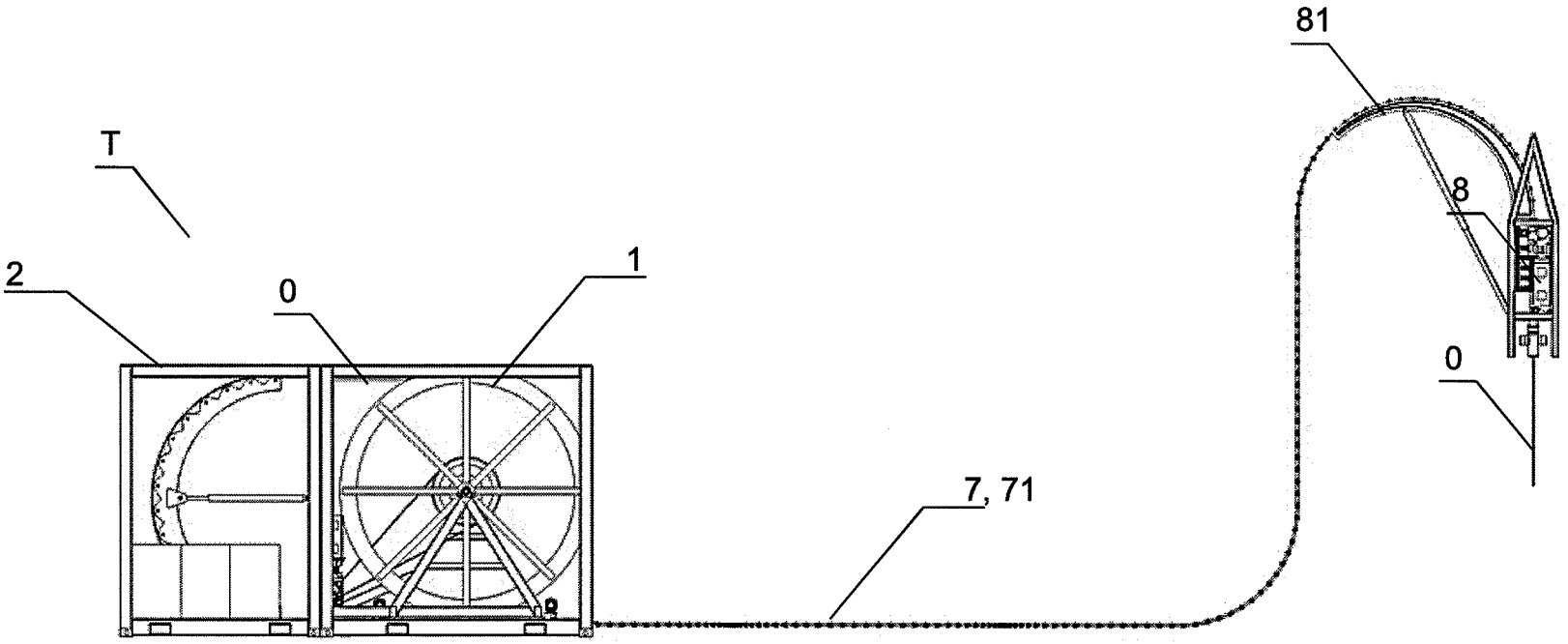
FIG. 3 is a side elevation view of the frame, the drum and the compensator according to the invention, with a generally closed guideway comprising bending restrictors laid horizontally and over a gooseneck to an injector head on a well.

In an embodiment of the invention, an intervention string guide channel (7) of fixed length may be arranged between the second fixed guide (5) and an injector head (8) on said well, please see FIG. 3. The guide channel may comprise at least two bend restrictors (71) for the intervention string (0). The guide channel (7) including the bend restrictors (71) is preferably closed due to safety considerations. This has clear advantages; personnel and cranes cannot interfere directly with any running intervention string. The guide channel (7) may advantageously comprise pipes of fixed shape in combination with bend restrictors. In this manner the drum unit may be placed far from the injector head and the guide channel may be laid along deck and guided along inclined paths through fixed pipe sections without requiring much space along its path. The guide channel (7) may advantageously be lined with a Teflon pipe in order to reduce friction and wear.

As an alternative to the use of the drum unit being placed separate from the wellhead injector as shown in FIG. 3, in an embodiment of the invention the drum unit may be connected directly on the well so as for the intervention string to run directly from said fixed guide (5) of the structural frame (2) to the injector head (8), i.e. that the structural frame (2) to be arranged directly above the injector head (8).

The intervention string (0) is a relatively rigid fibre reinforced cable (01), generally of a slick carbon fibre type, or a coiled tubing (02) or an otherwise slick metal string (03). The intervention string may comprise an electrical conductor, a fluid communication line, a signal fibre, or combinations of two or all of those.

The drum unit illustrated in FIG. 1 has a typical length of 7.14 m, a height of 4.20 m, and a width of 2.49 m. The total length of the unit may prove impractical for transport. In an embodiment the drum unit's structural frame (2) is assembled from a drum frame (2A) and a compensator frame (2B) which may be disconnected and reassembled.

The guide arch (32) is in an embodiment of the invention provided with a series of small sheaves (34) along its radially outward facing arch length for supporting and guiding the intervention string (0). The sheaves guide the intervention string and reduces friction between the string and the guide arch. As the string runs externally along the arch on the sheaves the arch must keep the intervention string in a tension sufficient for the string to bend into the bending radius of the intervention arch. This is obtained using the force device (6) to take up any slack of the string. Additionally, the tension of the string may be controlled using the first and second guides' (4, 5) tensioner rollers.

As mentioned above, the compensator must tighten or yield the intervention string when speed variations between the injector head's feeding speed and the speed of the drum occur. Further, the drum shall operate as a slave subordinate to the injector head. To achieve this, the drum unit is in an embodiment provided with a control system (CS) arranged for receiving control signals from a higher order control system for the injector head (8) on the wellhead. The higher order control system sends commands for feeding down, halting, or hauling up the intervention string. Further, the control system sets the speed required for the intervention string (0) accordingly. The control system is arranged for coordinating the movements of the intervention string on the drum (1) with the movement of the intervention string running through the injector head (8). As the two have different inertia, differences during injection and hauling are taken up by using the compensator. After having compensated for a reduced tension in the string due to high rotational inertia of the drum and coiled-up string when the injector head suddenly reduces its speed, the compensator arch is run outwardly relative to the drum axis. If, conversely, the injector head increases its injection speed, the compensator arch may be allowed to run inwardly in order for allowing the drum to catch up, and subsequently the compensator arch is returned to near a neutral middle position in order for meeting a subsequent need for slacking or tensioning the string.

The above described embodiments may all be combined except when mutually exclusive. An example of mutually exclusive combinations is the fact that a rigid guide arch (31) cannot be arranged pivotable about both the upper and the lower axis (32, 33) at the same time, because the guide arch then would be locked in place.

As mentioned under the initial presentation of problems related to prior art, problems caused by relative speed variations between the drum and the injector head may be remedied using a free hanging cable between the gooseneck and the drum. However, the inertia problems become more apparent if a string channel of fixed length outside the wellhead, e.g. with a series of bend restrictors is used, because this creates a fixed distance between the spooling unit and injector head, and this requires compensation for speed variations. In such situations the tension compensator of the invention becomes a significant advantage.

The present invention has been indicated as a drum unit (T) for an intervention string (0) for a well. First and foremost a petroleum well is the intended area of use, but a geothermal well or a water well is also possible.

The invention claimed is:

1. A tension compensating external laying drum unit for an intervention string for a well having a well head injector, comprising:

a drum for said intervention string with a drum axis and with a radius, arranged in a structural frame and rotatable by a motor;

a tension compensator for said intervention string, wherein said tension compensator comprises a guide arch with an upper first end and a lower second end opposite the first end, the guide arch displaceable in a direction generally along the intervention string, orthogonal to said drum axis, wherein the guide arch is pivotable about a first axis extending perpendicular through the upper first end of the guide arch or a second axis extending perpendicular through the lower second end of the guide arch using a first force device connected to said structural frame for keeping said intervention string in tension;

wherein at least the first end of said guide arch is laterally displaceable in a direction generally orthogonal to said intervention string, parallel with said drum axis, wherein said intervention string runs between said guide arch to or from said first end to said drum; and wherein said intervention string runs via a second, opposite end of said guide arch via a fixed guide at said structural frame, directly or indirectly via the injector to or from said well.

2. The drum unit according to claim 1, wherein the guide arch is provided with a second force device for moving said first end laterally so as for steering said intervention string onto said drum.

3. The drum unit according to claim 1, wherein the base of said drum is provided with a groove so as for guiding the base layer of the intervention string into a desired pattern on the drum.

4. The drum unit according to claim 1, wherein the curve radius of said guide arch is smaller near the lower second end and increases towards the upper first end.

5. The drum unit of claim 1, wherein said guide arch is arranged linearly displaceable in the direction of the intervention string.

6. The drum unit according to claim 1, wherein said first force device comprises a spring mechanism.

7. The drum unit according to claim 1, wherein said first force device comprises a pneumatic, hydraulic or electrical actuator.

8. The drum unit according to claim 1, wherein said drum is arranged in bearings on an auxiliary frame.

9. The drum unit according to claim 1, comprising one or more string tension feeder units arranged on said structural frame so as for exerting at least a minimally required tension on said intervention string outwardly directed from said drum and arranged for feeding said intervention string in a desired direction outwardly from or inwardly to said drum.

10. The drum unit according to claim 9, with a tension feeder unit arranged at a first guide said tension feeder unit arranged laterally moving with said first end of said guide arch.

11. The drum unit according to claim 9, said tension feeder unit at said first guide arranged on said first end of said tension compensator.

12. The drum unit according to claim 9, said tension feeder unit at said first guide arranged laterally displaceable on said structural frame, said tension feeder unit arranged laterally moving in lateral synchronous operation with said first end of said guide arch by means of an actuator.

13. The drum unit according to claim 9, wherein said tension feeder unit comprises one or more motorized rollers or belts oppositely arranged on either sides of said intervention string's path and arranged for gripping and exerting a longitudinally directed force on said intervention string.

14. The drum unit according to claim 1, with a tension feeder unit arranged by the fixed guide at an entry point for said string on said structural frame.

15. The drum unit according to claim 1, wherein said fixed guide and an injector head on said well is arranged an intervention string guide channel with at least one bend restrictor for said intervention string.

16. The drum unit of claim 15, wherein said guide channel comprises pipes of fixed shape in combination with bend restrictors.

17. The drum unit according to claim 1, wherein said intervention string runs directly from said fixed guide to said injector head.

18. The drum unit according to claim 1, wherein said intervention string is a rigid fiber reinforced cable or a coiled tubing, braided wire, or an otherwise slick metal string.

19. The drum unit according to claim 1, wherein said structural frame is assembled from a drum holding frame and a compensator holding frame.

20. The drum unit according to claim 1, wherein said guide arch is provided with a series of sheaves along said guide arch for supporting and guiding said intervention string.

21. The drum unit according to claim 1, provided with a control system (CS) arranged for receiving control signals from a higher order control system for said injector head on said wellhead, said higher order control system for commanding feeding down, halting or hauling up and setting a speed of said intervention string, and arranged for coordinating said drum with said injector head.

22. The drum unit of claim 1, said drum having a radius (R) equal or larger than a smallest allowable bending radius (R0).

23. The drum unit of claim 1, said guide arch having a radius (Rg) larger than or equal to a smallest allowable bending radius (R0).

24. The drum unit of claim 1, said guide arch having a curve radius (Rg) varying from a lower curve radius near its second end to a higher curve radius near its first end closer to the drum as counted along the string's path.

25. The drum unit of claim 1, wherein the drum is an external laying drum.

26. The drum unit of claim 1, wherein an axial length (the width) of said drum is between one third and an entire width of said frame measured along said axis.

27. The drum unit of claim 1, wherein an axial length (the width) of said drum corresponds to an internal width of said frame measured along said axis.

28. The drum unit of claim 1, wherein the guide arch is pivotable about the second axis extending through the second end of the guide arch.

* * * * *